US005946800A

United States Patent [19]

Daigo

[11] Patent Number: 5,946,800

[45] Date of Patent: Sep. 7, 1999

[54] METHOD FOR PRODUCING ROCKER ARMS

[75] Inventor: Fumichika Daigo, Tochigi-ken, Japan

[73] Assignee: Nippon Piston Ring Co., Ltd., Tokyo-to, Japan

[21] Appl. No.: 08/903,740

[22] Filed: Jul. 31, 1997

[30] Foreign Application Priority Data

Jul. 31, 1996 [JP] Japan ..... 8-202134

[51] Int. Cl.[6] ..... B23P 15/00

[52] U.S. Cl. ..... 29/888.2; 29/888

[58] Field of Search ..... 29/888.2, 888; 74/519

[56] References Cited

U.S. PATENT DOCUMENTS

| | | | |
|---|---|---|---|
| 4,825,717 | 5/1989 | Mills | 74/519 |
| 4,829,647 | 5/1989 | Anderson et al. | 29/888.2 |
| 5,678,305 | 10/1997 | Nagano et al. | 29/888.2 |
| 5,774,984 | 7/1998 | Kotani | 29/888.2 |

FOREIGN PATENT DOCUMENTS

| | | |
|---|---|---|
| 1-91931 | 4/1989 | Japan . |
| 3-110040 | 5/1991 | Japan . |
| 7-269311 | 10/1995 | Japan . |

*Primary Examiner*—I. Cuda
*Attorney, Agent, or Firm*—Evenson, McKeown, Edwards & Lenahan, P.L.L.C.

[57] ABSTRACT

A method for producing dimensionally accurate rocker arms formed with a roller-receiving portion at one end. The method of the invention produces rocker arms which have a roller-receiving, fork-like portion at one end of the rocker arm body for receiving a roller contacting a cam. The method uses the steps of inserting between the opposed inner surfaces of the roller-receiving portion an insert jig having a parallel surface and a slant surface inclined inwardly of the jig by a predetermined angle from the parallel surface; placing a pressing jig on an outer surface of the roller-receiving portion, the surface of the pressing jig to be contacted with the outer surface of the roller-receiving portion having a parallel surface and a slant surface inclined outwardly of the pressing jig by a predetermined angle from the parallel surface; and applying pressure to the pressing jig to thereby press the inner surfaces of the roller-receiving portion against the surfaces of the insert jig. The predetermined angles of the insert jig and the pressing jib are respectively in the range of from about 2° to about 4°.

15 Claims, 5 Drawing Sheets

METHOD FOR PRODUCING ROCKER ARMS

This application claims the priority of Japanese Patent Application No. 202134/1996, filed Jul. 31, 1996.

BACKGROUND OF THE INVENTION

The present invention relates to a method for producing rocker arms used in a valve-operating system of an internal combustion engine. More particularly, this invention relates to a dimensional improvement of a roller-receiving portion formed of one end of a rocker arm.

A rocker arm is a constituent part for converting rotary motion of a cam which rotates and connects to a valve-operating system, namely a crank shaft in an internal combustion engine, to reciprocative motion of a valve shaft of the intake or exhaust valve of the engine.

In known constructions, since one end of the rocker arm contacts a cam shaft which rotates at high speed, it has been formed with the roller-receiving end portion as an insert made of a wear-resistant, high alloy steel, or by formation of a rocker arm body made of a low alloy steel integral with such end portion. However, in recent years, with high output power and compactness of engines, rocker arms provided with a roller have mainly been employed instead of the described chip.

For instance, a rocker arm is known which has a roller, as shown in FIG. 4. This rocker arm is so formed that it has in its body an opening passing through the upper and lower surfaces for receiving a roller which rotatably contacts with the cam shaft. The described roller is provided in the opening so that the end surfaces of the roller are opposed to the inner surfaces, that is, they come face to face with the inner surfaces of the opening, with a small clearance therebetween.

Furthermore, as shown in FIG. 5, there has also been another type of rocker arm which is of a roller type and is able to operate two valves simultaneously. This rocker arm consists of a rocker arm body and a roller, and is formed with a roller-receiving opening nearly in the central portion of the rocker arm body, the roller being held within the opening. The rocker arm body is divided approximately at its central portion with the sides of the resulting two body portions respectively provided with a pawl contacting a valve. The rocker arm, therefore, is of an approximate U-shape or an approximate Y-shape as seen in a plan view.

Because such rocker arms are rather complicated, they have been manufactured by a sintering method in which a metallic powder is sintered. The sintering method produces a product which is quite accurate in size, but its productivity is limited, which results in an increase of production cost. Otherwise, as other methods for replacing this, a precision casting method and a die forging method have been carried out as a more efficient production method. Although both the precision casting and die forging methods are excellent in productivity, they have low accuracy in size, so that there are seen some problems of being unstable in the space between the valve-contacting, valve-pressing portions and in the space between the opposed inner surfaces of the roller receiving opening in which a roller is held, and being rough on these surfaces.

To solve these problems, for example, Japanese Patent Laid-Open (kokai) No. 91931/1989, of which the entire disclosure is expressly incorporated herein by reference, discloses an improved method for the rocker arm shown in FIG. 4, in which a smooth-faced correction block is inserted into a roller-mounting opening formed in a rocker arm body with a limited clearance therebetween and then an outer surface of the rocker arm body is pressed, said outer surface being opposed to the inner surface of the roller-mounting opening. According to this method, the space between the inner surfaces of the roller-mounting opening is made to a predetermined accuracy and the smoothness of these surfaces is elevated. However, owing to the pressing, the correction block sticks to the inner surfaces of the roller-mounting opening, which results in the drawback that it is hard to dismount the correction block from the opening.

Japanese Patent Laid-Open (kokai) No. 110040/1991, of which the entire disclosure is expressly incorporated herein by reference, discloses another improved method, for the rocker arm shown in FIG. 5, in which a correction block is inserted into a roller-mounting opening of an unfinished product formed to a predetermined shape, and then the unfinished product is pressed at its roller-mounting opening from the outside thereof to make the inner surfaces of the roller-mounting opening smoother as well as to press pawl portions so as to correct the interval between the pawls. According to this method, the space between the inner surfaces of the roller-mounting opening is adjusted to a predetermined accurate size, and in addition thereto the smoothness of these surfaces is improved. However, since the entire breadth of the rocker arm is pressed from the outside thereof, a considerable pressing force is needed, so that residual stresses will occur after deformation and the pressing leads to sticking of the correction block to the inner surfaces of the roller-mounting opening, and therefore there is caused a drawback that the correction block cannot be easily dismounted.

Japanese Patent Laid-Open (kokai) No. 269311/1995, of which the entire disclosure is expressly incorporated herein by reference, discloses a further improved method for the rocker arm shown in FIG. 5, in which a roller-receiving portion is produced in such a way that the space between the opposed sides of the rocker arm is slightly smaller than a predetermined size, and then a pair of correction blocks are inserted between both sides and a press tool is wedged into a gap between the blocks to force the gap open to thereby improve the space between both sides and to improve the smoothness of the side surfaces.

Furthermore, in FIG. 1, a rocker arm is shown which is formed with a roller-receiving portion at one end thereof. In such rocker arm formed with a roller-receiving portion at one end thereof, a problem arises in that the space between the inner surfaces of the roller-receiving portion is apt to be broadened in a heat treatment to a size which exists outside a predetermined accuracy. Thus, an improvement in dimensional accuracy is desired. Also, especially in recent years, small sized rocker arms have been produced by an injection molding technique, in which metallic powder together with a binder is injected and filled into a metal mold in an injection molding machine to form a blank. Such blank formed by an injection molding is heated to remove the binder and thereafter is sintered to form the product. Although the production of parts by injection molding has the advantage of high productivity, it needs sintering at a temperature higher than those in conventional sintering methods, which results in the drawback that a larger change in size will result. In particular, relative to the rocker arm formed with a roller-receiving portion at one end thereof as shown in FIG. 1, the interval between the inner surfaces of the roller-supporting portions of the roller-receiving portion in a sintering and heat treatment process in which a roller is held, is considerably broadened so that there is caused a drawback that a determined accuracy in size cannot be obtained.

SUMMARY OF THE INVENTION

It is an object of the present invention to provide an improved method for producing rocker arms which is free of the aforementioned and other such disadvantages.

It is another object of the present invention to provide an improved method for producing rocker arms with excellent accuracy in size, formed with a roller-receiving portion at one end thereof.

To accomplish the objects of the invention, a method is provided for producing rocker arms having at one end thereof a roller-receiving, fork-like portion for receiving a roller which is arranged to contact with a cam, wherein said method comprises inserting between the opposed inner surfaces of the roller-receiving portion an insert jig having a pair of surfaces respectively facing the opposed inner surfaces of said roller-receiving portion, one of the pair of surfaces comprising a surface parallel with the other opposite surface and a slant surface inclined inwardly of the jig by a predetermined angle from said parallel surface; placing a pressing jig against an outer surface of the roller-receiving portion, the surface of the pressing jig to be contacted with the outer surface of the roller-receiving portion comprising a surface parallel to the opposite surface and a slant surface inclined outwardly of the pressing jig by a predetermined angle from said parallel surface thereof; and applying pressure on the pressing jig to thereby press the inner surfaces of the roller-receiving portion against the surfaces of the insert jig. The predetermined angle of said insert jig is preferably in a range of from 2° to 4°, and the predetermined angle of said pressing jig is preferably in a range of from 2° to 4°.

Other objects, advantages and applications of this invention will be made apparent by the following detailed description. The description makes reference to a preferred and illustrative embodiment of the invention presented in the accompanying drawings wherein:

DESCRIPTION OF THE PREFERRED EMBODIMENTS

The invention and advantageous details will now be explained more fully with reference to exemplary embodiments.

Figure 1A:
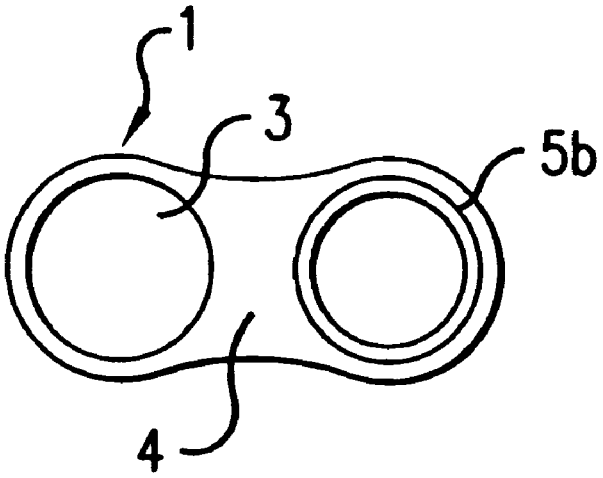
FIGS. 1(*a*) and 1(*b*) are schematic representations of a rocker arm to which the method of the present invention is applied, with FIG. 1(*a*) being a plan view and FIG. 1(*b*) being a front elevational view.
Figure 1B:
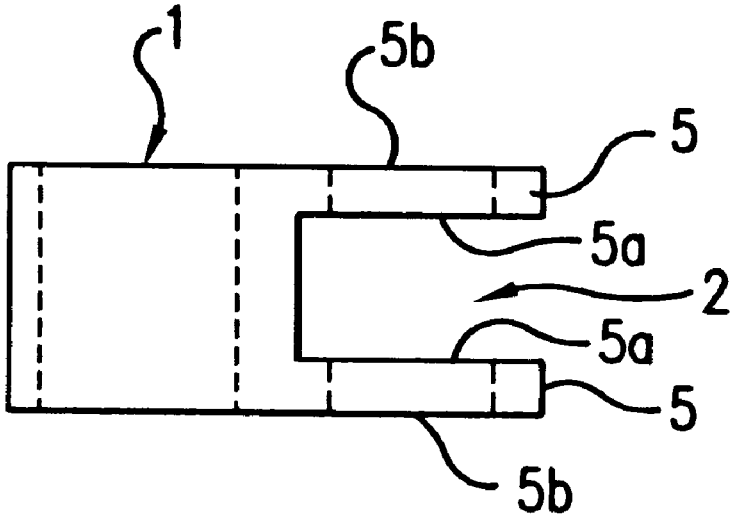

The method of the invention is applied to a rocker arm formed with a roller-receiving portion which houses a roller adapted to contact with a cam, as shown in FIG. 1. The rocker arm 1 comprises a roller-receiving portion 2, a mounting portion 3 in which a rocker arm shaft is held, and a connecting portion 4. The roller-receiving portion of the rocker arm has a pair of roller-supporting portions 5, 5 formed in a fork-like shape, between which a roller is housed in such a manner that both end surfaces of the roller are respectively opposed to the inner surfaces 5*a*, 5*a* of said roller-supporting portions.

The present invention is for correcting, with a determined dimensional accuracy, the interval between both inner surfaces of the roller-receiving portion formed at one end of the rocker arm.

An insert jig 6 is inserted between both inner surfaces 5*a*, 5*a* of the roller-receiving portion, said insert jig comprising a pair of surfaces respectively opposed to the inner surfaces of said roller-receiving portion, one of the pair of surfaces comprising a surface parallel with the other opposite surface thereof and a slant surface inclined inwardly of the jig by a predetermined angle from the parallel surface.

Figure 2A:
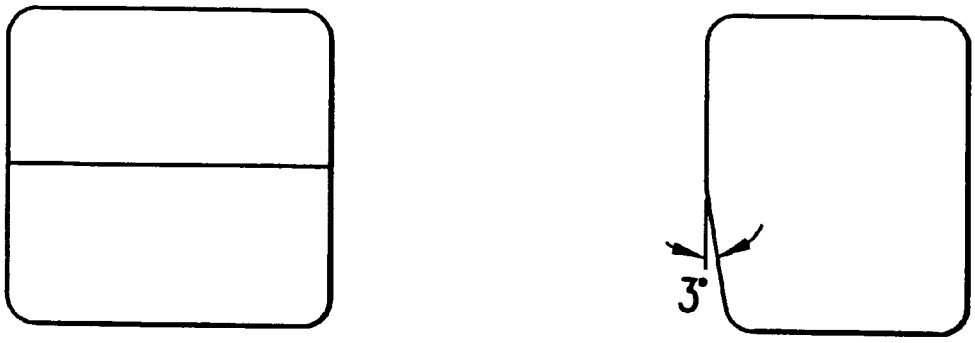
FIG. 2(*a*) shows schematically an insert jig and FIG. 2(*b*) shows schematically a pressing jig which are used in the method of the invention.
Figure 2B:
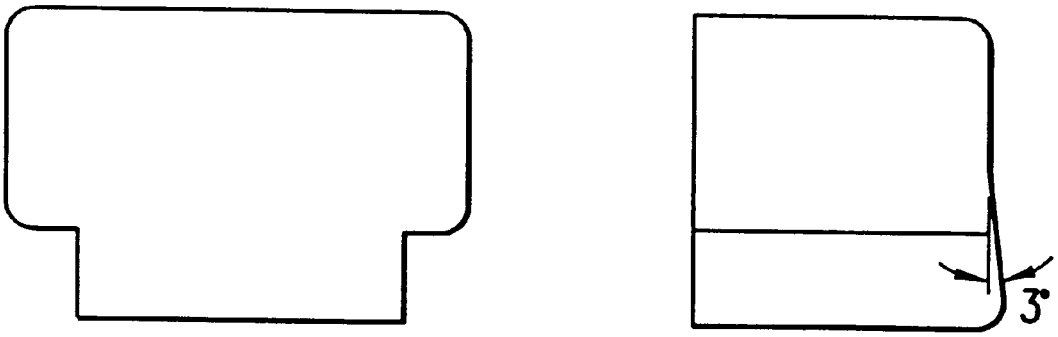

An example of the insert jig is shown in FIG. 2. This jig has a high hardness of HRc58 or higher, and the surface roughness of the jig is preferably in the range of from 1 S to 6 S. The predetermined angle of the slant surface is preferably in the range of from 2° to 4°. If the angle of the slant surface is less than 2° or exceeds 4°, it is hard for the size of the roller-receiving portion to be maintained within the desired accuracy.

Next, a pressing jig 7 is placed on an outer surface 5*b* of the roller-receiving portion of which the inner surface is opposed to the surface having the slant surface 6*a* of the insert jig 6. The surface of the pressing jig 7 which is adapted to contact with the outer surface 5*b* of the roller-receiving portion comprises a surface parallel with the opposite surface, namely its reverse surface and a slant surface 7*a* inclined outwardly of the pressing jig by a predetermined angle from the parallel surface.

After the pressing jig 7 is placed on the outer surface 5*b* of the roller-receiving portion, said pressing jig 7 is pressed until the inner surfaces of the roller-receiving portion are thoroughly pressed on the surfaces of the insert jig so as to correct the dimension of the roller-receiving portion to a finished one.

The method of the invention comprises providing the partial slant surface in both the surface of the insert jig and the surface of the pressing jig. Thus, each jig is not a complete parallelepiped having perfectly parallel surfaces. Also, it is important for both slant surfaces provided in both jigs to have an inclination contrary to each other. In this manner, the space between the inner surfaces of the roller-receiving portion can be corrected to a determined dimension with an excellent accuracy. If correction jigs of a mere parallelepiped having a parallel surfaces are used and placed in the interior and on the outer surface of the roller-supporting portion to press them from outside thereof, the dimension cannot be corrected to a predetermined one with a high accuracy.

Concerning the rocker arm to which the invention can be applied, since it has a pair of the roller-supporting portions formed in a fork-like shape, the ends of the roller-supporting portions are apt to be enlarged. Accordingly, I press the space between the inner surfaces of the roller-supporting portions, especially the space of the ends thereof to a dimension smaller than the predetermined one, in other words to bend forcedly inwardly portions adjacent the ends of the roller-supporting portions whereby the said portions are deformed additionally by an amount to be restored elastically in view of an elastically restoring amount to attain easily the predetermined dimensional accuracy.

Therefore, both the inside and outside jigs have a surface comprised of a parallel surface extending to an approximately intermediate portion thereof and a slant surface of the remainder, not a uniform slant or tapered surface. These slant surfaces are inclined in such a manner that the space between the inner surfaces of the roller-supporting portions reduces, that is, an inclination of the inside jig is desirably in a direction such that the thickness of the jig is decreased, whereas the outside jig has an inclination desirably in a direction such that the thickness of the jig is increased.

As the rocker arm to which the invention is applicable, any rocker arm may be used which is a product of a rolled blank or cast blank by machining, a sintered product made of metallic powder, or an injection-molded product formed by injection molding in which metallic powder together with a binder is injected and filled into a metal mold in an injection molding machine and thereafter is heated to remove the binder and then sintered. In particular, the products formed by injection molding can be desirably used.

A rocker arm was produced by injection molding, as shown in FIG. 1, which was provided with a roller-receiving portion at one end thereof. In the injection molding, metallic powder together with a binder was injected and filled into a metal mold to form a predetermined size and shape and thereafter was heated to remove the binder to obtain a blank. This blank was sintered to form a rocker arm. The dimension between the roller-supporting portions after inserting did not satisfy a predetermined dimensional accuracy.

Figure 3:
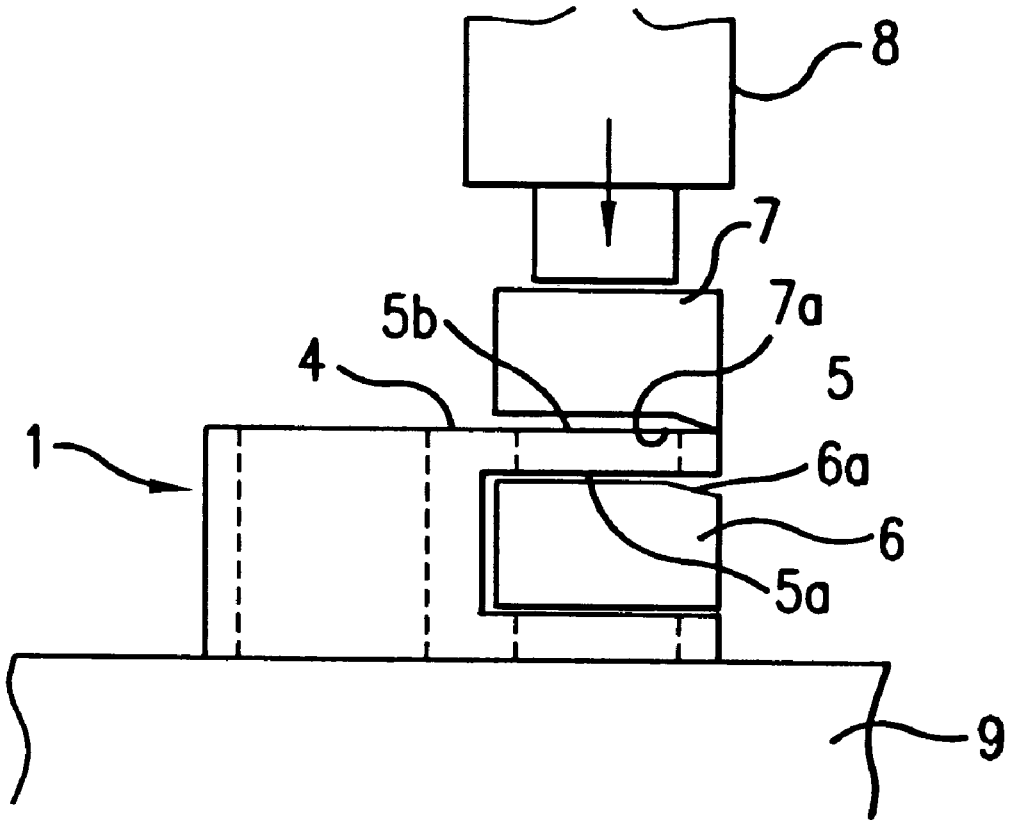
FIG. 3 is an explanatory view showing an embodiment of a method for producing rocker arms according to the invention.
Figure 4A:
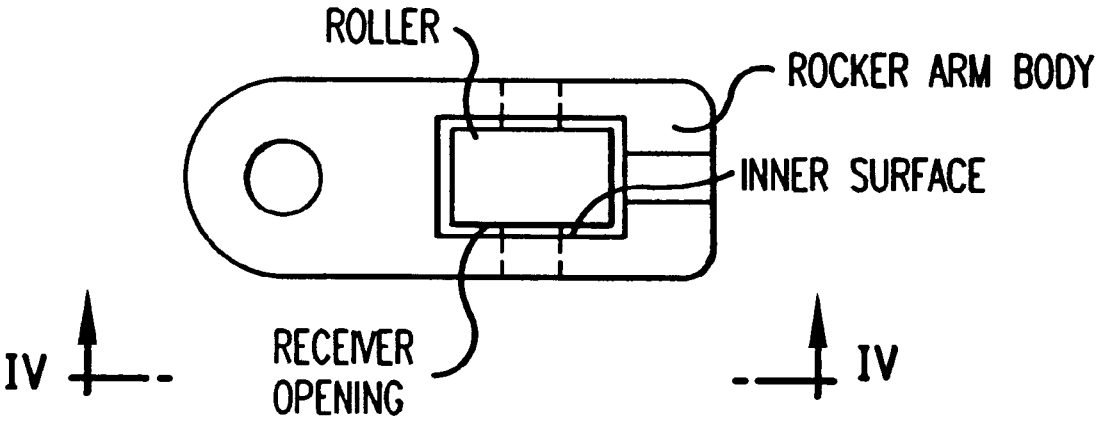
FIG.4(a) PRIOR ART
FIGS. 4(*a*) and 4(*b*) show an example of a rocker arm according to the prior art, wherein FIG. 4(*a*) shows a plan view and FIG. 4(*b*) shows a side elevational view seen from arrows IV—IV in FIG. 4(*a*)
Figure 4B:
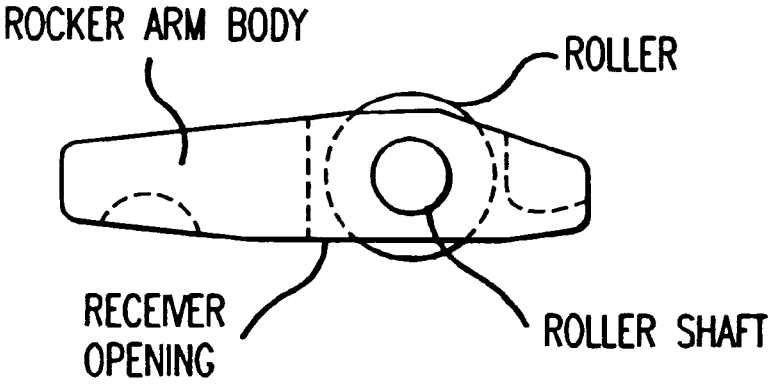
FIG.4(b) PRIOR ART
Figure 5A:
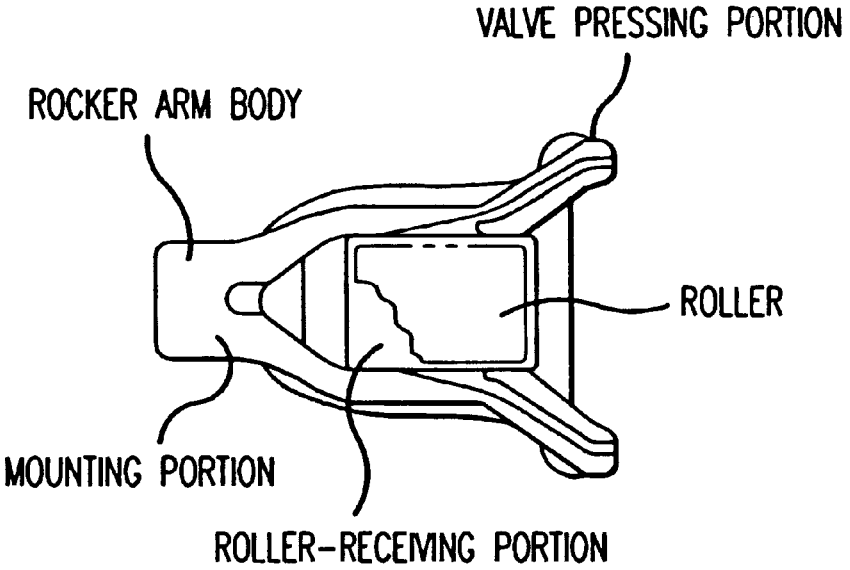
FIG.5(a) PRIOR ART
FIGS. 5(*a*) and 5(*b*) show another example of a rocker arm according to the prior art, wherein 5(*a*) shows a plan view and FIG. 5(*b*) shows a front elevational view.
Figure 5B:
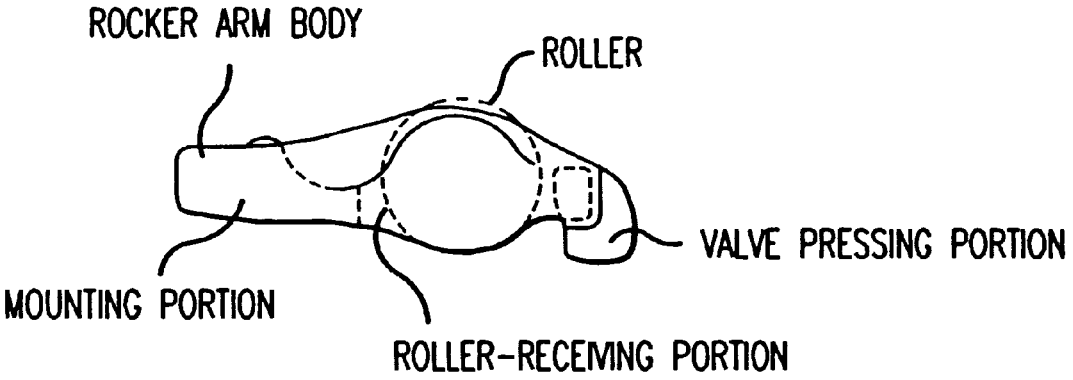
FIG.5(b) PRIOR ART

After sintering, as shown in FIG. 3 as an applied embodiment of the present invention, the formed rocker arm was placed on a press-table stand 9 of a press so that the outer surface 5*b* of the roller-supporting portion 5 was horizontal. Next, the insert jig 6 was inserted between the inner surfaces 5*a* of the roller-supporting portions in such a way that the slant surface 6*a* of the jig faced upwards, and thereafter the pressing jig 7 was placed so that the slant surface 7*a* contacted with the outer surface 5*b* of the roller-supporting portion. After that, the pressing jig 7 was pressed with a press ram 8 to thereby press the inner surfaces of the roller-receiving portion against the surfaces of the insert jig. If desired, the opposite roller-supporting portion could be pressed in the same manner. Incidentally, the angles of inclination of the respective slant surfaces of the insert jig 6 and the pressing jig 7 were each 3°.

According to this method, the dimension between the roller supporting portions was within the range of a predetermined dimensional accuracy. In a comparative example wherein parallelepiped jigs which did not have respectively a slant surface were used instead of the insert jig 6 and the pressing jig 7, such jigs placed in position were pressed similarly to the above applied example, to form a rocker arm in a press machine. As a result, the dimension between the roller-supporting portions was not within the range of a determined dimensional accuracy.

According to the method of the invention, excellent effects are obtainable, whereby dimensional accuracy is improved efficiently, and rocker arms of high grade can be produced at a lower cost.

It should be apparent from the foregoing detailed description that the objects set forth at the outset to the specification have been successfully achieved. Moreover, while there is shown and described present preferred embodiments of the invention, it is to be distinctly understood that the invention is not limited thereto but may be otherwise variously embodied and practiced within the scope of the following claims.

What is claimed is:

1. A method for producing rocker arms having at one end thereof a roller-receiving, fork-like portion with opposed inner surfaces for receiving a roller which is to be arranged in contact with a cam, said method comprising:

inserting between the opposed inner surfaces of the roller-receiving portion an insert jig having a pair of surfaces respectively facing the opposed inner surfaces of said roller-receiving portion, one of the pair of surfaces comprising a surface parallel with the respective opposed inner surface and a slant surface inclined inwardly of the jig by a predetermined angle from said parallel surface;

placing a pressing jig on an outer surface of the roller-receiving portion, a pressing surface of the pressing jig to be contacted with the outer surface of the roller-receiving portion comprising a surface parallel with the outer surface and a slant surface inclined outwardly of the pressing jig by a predetermined angle from said parallel surface thereof; and applying pressure to the pressing jig to thereby press the inner surfaces of the roller-receiving portion against the pair of surfaces of the insert jig.

2. The method for producing rocker arms set forth in claim 1, wherein said predetermined angle of the insert jig is in the range of from about 2° to about 4°.

3. The method for producing rocker arms set forth in claim 1, wherein said predetermined angle of the pressing jig is in the range from about 2° to about 4°.

4. The method for producing rocker arms set forth in claim 2, wherein said predetermined angle of the pressing jig is in the range from about 2° to about 4°.

5. The method for producing rocker arms according to claim 1, wherein in said applying pressure step, a distal portion of the roller-receiving portion is clamped between said slant surface of the insert jig and said slant surface of the pressing jig, said distal portion of the roller-receiving portion being pressed laterally inwardly of a remaining portion of the roller-receiving portion which is clamped between said parallel surface of the insert jig and said parallel surface of the pressing jig.

6. The method for producing rocker arms according to claim 5, wherein said distal portion of the roller-receiving portion is pressed laterally inwardly of a predetermined desired final position, said distal portion being elastically restored to said predetermined desired final position following said applying pressure step.

7. The method for producing rocker arms as set forth in claim 1, wherein said roller-receiving portion extends in a substantially perpendicular direction from a connecting portion of the rocker arm to a distal portion, said slant surface of the insert jig and said slant surface of the pressing jig being located proximate said distal portion.

8. The method for producing rocker arms as set forth in claim 1, wherein said fork-like roller-receiving portion comprises a pair of roller-supporting portions extending substantially perpendicularly from a connecting portion of said rocker arm to free distal end portions.

9. A method for producing a rocker arm, said rocker arm having a connecting portion and a pair of roller-supporting portions extending substantially perpendicularly from said connecting portion to free distal end portions, said pair of roller-supporting portions having a pair of respective inner surfaces facing each other which define a space for receiving a roller to be engaged with a cam, said pair of roller-supporting portions having a pair of respective outer surfaces facing away from each other, said method comprising the steps of:

inserting an insert jig between said inner surfaces of the roller-supporting portions, said insert jig having a pair of supporting surfaces respectively facing the inner surfaces of said roller-supporting portion, at least one of said pair of supporting surfaces of the insert jig comprising a parallel surface parallel with the respective facing inner surface and a slant surface inclined inwardly of the insert jig by a predetermined angle from said parallel surface;

placing a pressing surface of a pressing jig on the outer surface of the roller-supporting portion opposite said at least one of said pair of supporting surfaces of the insert jig, said pressing surface comprising a surface parallel with the outer surface and a slant surface inclined outwardly of the pressing jig by a predetermined angle from said parallel surface thereof; and applying pressure to the pressing jig to thereby press the inner surfaces of the roller-supporting portion against the supporting surfaces of the insert jig.

10. The method for producing rocker arms set forth in claim 9, wherein said predetermined angle of the insert jig is in the range of from about 2° to about 4°.

11. The method for producing rocker arms set forth in claim 9, wherein said predetermined angle of the pressing jig is in the range from about 2° to about 4°.

12. The method for producing rocker arms set forth in claim 10, wherein said predetermined angle of the pressing jig is in the range from about 2° to about 4°.

13. The method for producing rocker arms according to claim 9, wherein in said applying pressure step, a distal portion of the roller-supporting portion is clamped between said slant surface of the insert jig and said slant surface of the pressing jig, said distal portion of the roller-supporting portion being pressed laterally inwardly of a remaining portion of the roller-supporting portion which is clamped between said parallel surface of the insert jig and said parallel surface of the pressing jig.

14. The method for producing rocker arms according to claim 13, wherein said distal portion of the roller-supporting portion is pressed laterally inwardly of a predetermined desired final position, said distal portion being elastically restored to said predetermined desired final position following said applying pressure step.

15. The method for producing rocker arms as set forth in claim 9, wherein said roller-supporting portion extends in a substantially perpendicular direction from a connecting portion of the rocker arm to a distal portion, said slant surface of the insert jig and said slant surface of the pressing jig being located proximate said distal portion.

* * * * *